US012590533B2

(12) United States Patent
Homan et al.

(10) Patent No.: US 12,590,533 B2
(45) Date of Patent: Mar. 31, 2026

(54) DROPPABLE OBJECT WITH LOCATING SYSTEM AND PRESSURE PULSE TELEMETRY ACTUATOR FOR USE IN A WELLBORE

(71) Applicant: Schlumberger Technology Corporation, Sugar Land, TX (US)

(72) Inventors: Dean M. Homan, Damon, TX (US); Laurent Yves Claude Coquilleau, Houston, TX (US); Jose Raul Contreras Escalante, Richmond, TX (US); Artem Kabannik, Park Row, TX (US); Eugene Janssen, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/778,497

(22) Filed: Jul. 19, 2024

(65) Prior Publication Data

US 2026/0022635 A1 Jan. 22, 2026

(51) Int. Cl.

| | |
|---|---|
| ***E21B 47/09*** | (2012.01) |
| ***E21B 33/13*** | (2006.01) |
| ***E21B 47/18*** | (2012.01) |

(52) U.S. Cl.

CPC ..... *E21B 47/09* (2013.01); *E21B 33/13* (2013.01); *E21B 47/18* (2013.01)

(58) Field of Classification Search

CPC ..... E21B 34/142; E21B 23/0413; E21B 47/09

See application file for complete search history.

(56) References Cited

U.S. PATENT DOCUMENTS

| | | | |
|---|---|---|---|
| 4,819,726 | A | 4/1989 | Beirute |
| 5,754,495 | A | 5/1998 | Skinner |
| 6,084,403 | A | 7/2000 | Sinclair |
| 6,125,935 | A | 10/2000 | Shahin, Jr. |
| 6,401,814 | B1 | 6/2002 | Owens |
| 7,322,417 | B2 | 1/2008 | Rytlewski |

(Continued)

FOREIGN PATENT DOCUMENTS

| | | | |
|---|---|---|---|
| EP | 1083298 | B1 | 2/2006 |
| WO | 2015187165 | A1 | 12/2015 |
| WO | 2021040556 | A1 | 3/2021 |

OTHER PUBLICATIONS

Kalman, R. E., "A New Approach to Linear Filtering and Prediction Problems", Journal of Basic Engineering, 1960, 12 Pages, vol. 82.

(Continued)

*Primary Examiner* — Tara Schimpf
*Assistant Examiner* — Lamia Quaim
(74) *Attorney, Agent, or Firm* — Kyle R. Miiller

(57) ABSTRACT

A system and method for determining the location of a droppable object in a wellbore. The droppable object includes an integrated locating system that detects completion components as the object moves through a casing string. The locating system includes an actuation device that is activated based on detection of the components. When activated, the actuation device exerts a radially directed frictional pressure against the inner wall of the casing string, thereby generating pressure pulse telemetry signals that are detected and analyzed by surface equipment to determine the object's downhole location.

9 Claims, 8 Drawing Sheets

(56) References Cited

U.S. PATENT DOCUMENTS

| | | | | |
|---|---|---|---|---|
| 7,325,616 | B2 | 2/2008 | Lopez de Cardenas | |
| 7,377,321 | B2 | 5/2008 | Rytlewski | |
| 7,387,165 | B2 | 6/2008 | Lopez de Cardenas | |
| 9,453,404 | B2 | 9/2016 | Shampine | |
| 9,546,548 | B2 | 1/2017 | Hartog | |
| 10,151,175 | B2 | 12/2018 | Booker | |
| 11,933,142 | B2 | 3/2024 | Kazanci | |
| 2013/0255963 | A1* | 10/2013 | Guerrero | E21B 33/12 166/373 |
| 2022/0145749 | A1* | 5/2022 | Watkins | E21B 47/138 |
| 2024/0026753 | A1* | 1/2024 | Acosta Villarreal | E21B 33/146 |

OTHER PUBLICATIONS

Moral, P. D., Nonlinear Filtering: Interacting Particle Resolution, Markov Processes and Related Fields, 1996, pp. 1-25, vol. 2.

Beirute, R.M., The Phenomenon of Free Fall During Primary Cementing, 59th Annual Technical Conference and Exhibition, Sep. 16, 1964, 12 Pages.

Li, T. et al., "Deterministic resampling: Unbiased sampling to avoid sample impoverishment in particle filters", Signal Processing, 2012, pp. 1637-1645, vol. 92.

Zhu, M. et al., "Towards Differentiable Resampling", arXiv:2004.11938v1, Apr. 24, 2020, 8 Pages.

Elfring, J. et al., "Particle Filters: A Hands-On Tutorial", Sensors, Jan. 9, 2021, pp. 1-28, vol. 438.

Korkin, R. et al., "Multiparticle Kalman filter for object localization in symmetric environments", arXiv:2303.07897v1, Mar. 14, 2023, pp. 1-15.

"Orion II Data compression platform", Retrieved from the internet: https://www.slb.com/products-and-services/innovating-in-oil-and-gas/drilling/surface-and-downhole-logging/measurements-while-drilling-services/orion-data-compression-mwd, 2009, 4 Pages.

"Measurement-while-drilling services" Retrieved from the internet: https://www.slb.com/products-and-services/innovating-in-oil-and-gas/drilling/surface-and-downhole-logging/measurements-while-drilling-services, Retrieved Date: May 5, 2025, 4 Pages.

* cited by examiner

DROPPABLE OBJECT WITH LOCATING SYSTEM AND PRESSURE PULSE TELEMETRY ACTUATOR FOR USE IN A WELLBORE

BACKGROUND

Hydrocarbon fluids such as oil and natural gas are obtained from a subterranean geologic formation, referred to as a reservoir, by drilling a well that penetrates the hydrocarbon-bearing formation. Often, during construction of the well, both during and after drilling, a tubular body, such as a casing or a liner is placed that is secured by cement pumped into the annulus around the outside of the tubular body. The cement serves to support the tubular body and to provide isolation of the various fluid-producing zones in the formation through which the well passes. This latter function prevents cross-contamination of fluids from different layers. For example, the cement prevents hydrocarbon fluids from entering the water table or prevents water from passing into the well instead of oil or gas. The cement sheath also can prevent corrosion of the tubular body.

The cement placement process is known in the industry as primary cementing. The goals of a primary cementing operation are to remove drilling fluid from the casing interior and borehole, place a cement slurry in the annulus around the exterior of the casing, and leave the casing interior filled with a displacement fluid, such as brine or water. However, primary cementing operations can often result in deviations from an ideal cement placement, leading to the need to perform additional time-consuming and costly remedial measures that then can delay subsequent operations. For example, if the cementing operation results in displacement fluid entering the annulus, contamination of the cement or absence of cement in a section of the annulus may result (i.e., referred to as a "wet shoe" in the industry). In such cases, a remedial squeeze cementing operation must be performed to correct the cement placement. In other situations, an excessive volume of the cement slurry may be left inside the casing. Again, this results in delay of subsequent operations as an additional drilling run must be performed to clear out the excessive cement. These issues can arise due to the difficulty of accurately tracking in real time the location of cement plugs that are deployed during the cementing operation.

SUMMARY

Certain embodiments of the present disclosure are directed to a method of determining the location of a droppable object as it travels in a wellbore. The method includes deploying the droppable object in a casing string that includes a plurality of completion components. The droppable object has an integral locating system that includes a sensor system and an actuator device. Fluid is pumped into the casing behind the object, causing the object to travel through the interior of the casing. The sensor system detects a completion component as the object travels past the component. A telemetry signal corresponding to detection of the completion component is generated for receipt by a surface acquisition system. Generation of the telemetry signal includes activating the actuator device so that it applies a radially directed force against an inner surface of the casing string, thereby generating a pressure pulse. The surface acquisition system determines the location of the object within the casing string based on the telemetry signal.

Further embodiments of the present disclosure are directed to a cement plug for use in a primary cementing operation performed in a wellbore. The plug includes a body for deployment in a fluid-filled casing string disposed in the wellbore and that includes a plurality of completion components. The plug further includes a locating system integral with the body to detect one or more of the completion components as the body travels through the casing string. The locating system includes an actuator device that is activated to generate one or more pressure pulse telemetry signals within the fluid-filled casing based on detection of the completion components.

Yet further embodiments of the present disclosure are directed to a system for determining the location of a droppable object during a cementing operation performed in a wellbore that penetrates a hydrocarbon bearing formation. The system includes a string having a passageway, a droppable object, and a fluid pumping system to pump fluid into the passageway behind the droppable object. The object has a body and a locating system integral with the body. The locating system includes an electromagnetic sensor and an actuator device. The locating system detects a component associated with the string by measuring changes in magnetic flux lines generated by the sensor that are caused by attributes of the component as the object moves through the passageway. The locating system activates the actuator device based on a measured change. When activated, the actuator device moves radially outward from the body and into frictional engagement with a wall of the passageway, thereby generating a pressure pulse signal. The system also includes an acquisition system located at the surface of the wellbore to receive the pressure pulse signal and to determine a location of the droppable object within the wellbore based on the pressure pulse signal.

BRIEF DESCRIPTION OF THE DRAWINGS

Certain embodiments are described with reference to the accompanying drawings, wherein like reference numerals denote like elements. It should be understood, however, that the accompanying drawings illustrate the various implementations described herein and are not meant to limit the scope of various technologies described herein. The drawings show and describe various embodiments of the invention.

DETAILED DESCRIPTION

In the following description, numerous details are set forth to provide an understanding of the present invention.

However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention.

Figure 1:
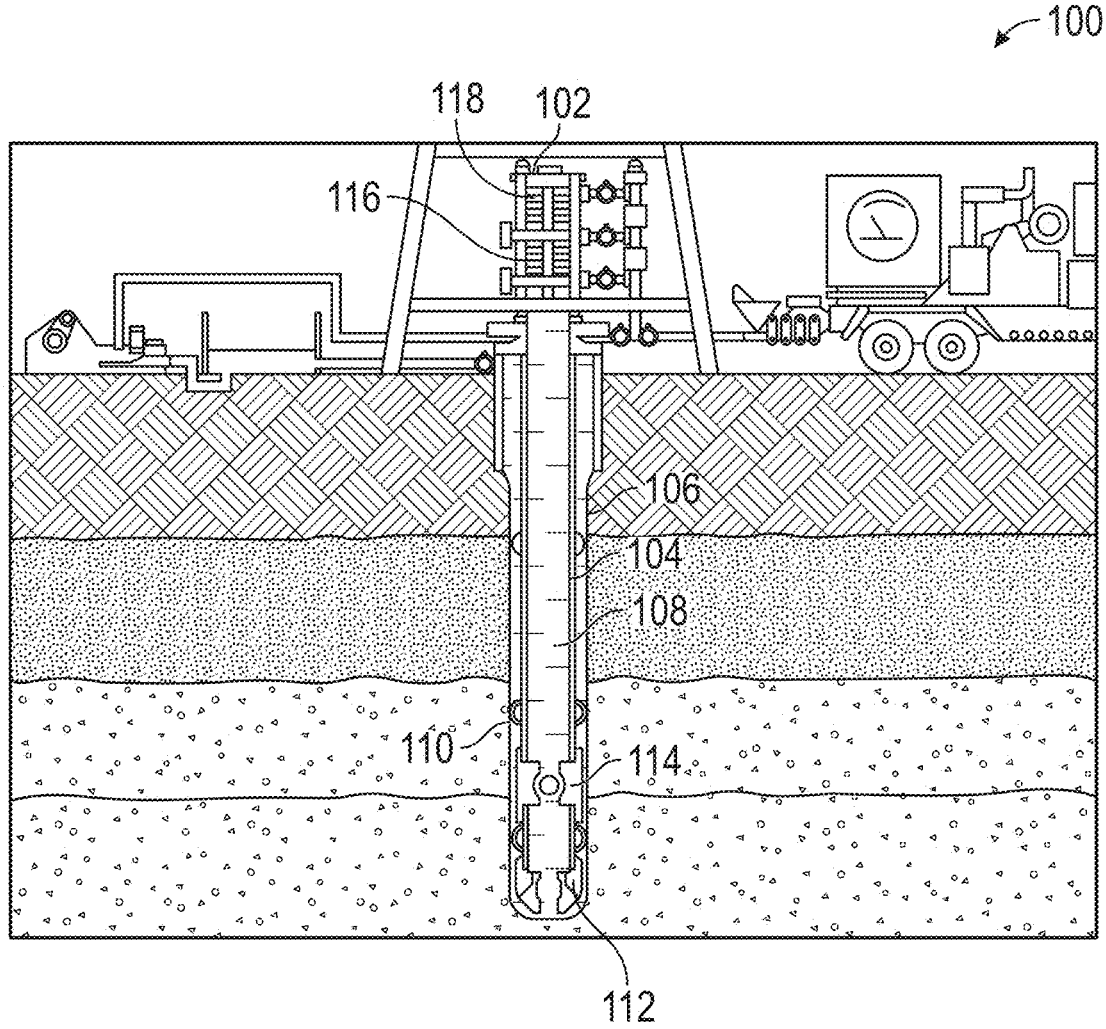
FIG. 1 (PRIOR ART)
FIG. 1 shows a typical wellsite configuration during a cementing operation.

Conventionally, many primary cementing processes use a two-plug cement-placement method. FIG. 1 shows a typical wellsite configuration 100 for a primary cementing operation. A cementing head 102 is situated on the surface, and a casing string 104 is lowered into a borehole 106. As the casing string 104 is lowered, the interior of the casing fills with drilling fluid 108. The casing string is centered in the borehole 106 by centralizers 110 attached to the outside of the casing string 104. Generally, centralizers are placed in specific casing sections to prevent sticking while the casing is lowered into the well. In addition, the centralizers keep the casing string in the center of the borehole to help ensure placement of a uniform cement sheath in the annulus between the casing and the borehole.

The bottom end of the casing string is protected by a guide shoe 112 and a float collar 114. Guide shoes are tapered, commonly bullet-nosed devices that guide the casing toward the center of the borehole to minimize hitting rough edges or washouts during installation. The guide shoe differs from the float collar in that it lacks a check valve. The check valve in a float collar can prevent reverse flow, or U-tubing, of fluids from the annulus into the casing. Inside the cementing head are a bottom cementing plug 116 and a top cementing plug 118. The cementing plugs, also known as cementing wiper plugs or wiper plugs, are elastomeric devices that provide a physical barrier between different fluids as they are pumped through the casing string interior. Most cementing plugs are made of a cast aluminum body with molded rubber fins that ensure steady movement through a casing or tubing.

Figure 2:
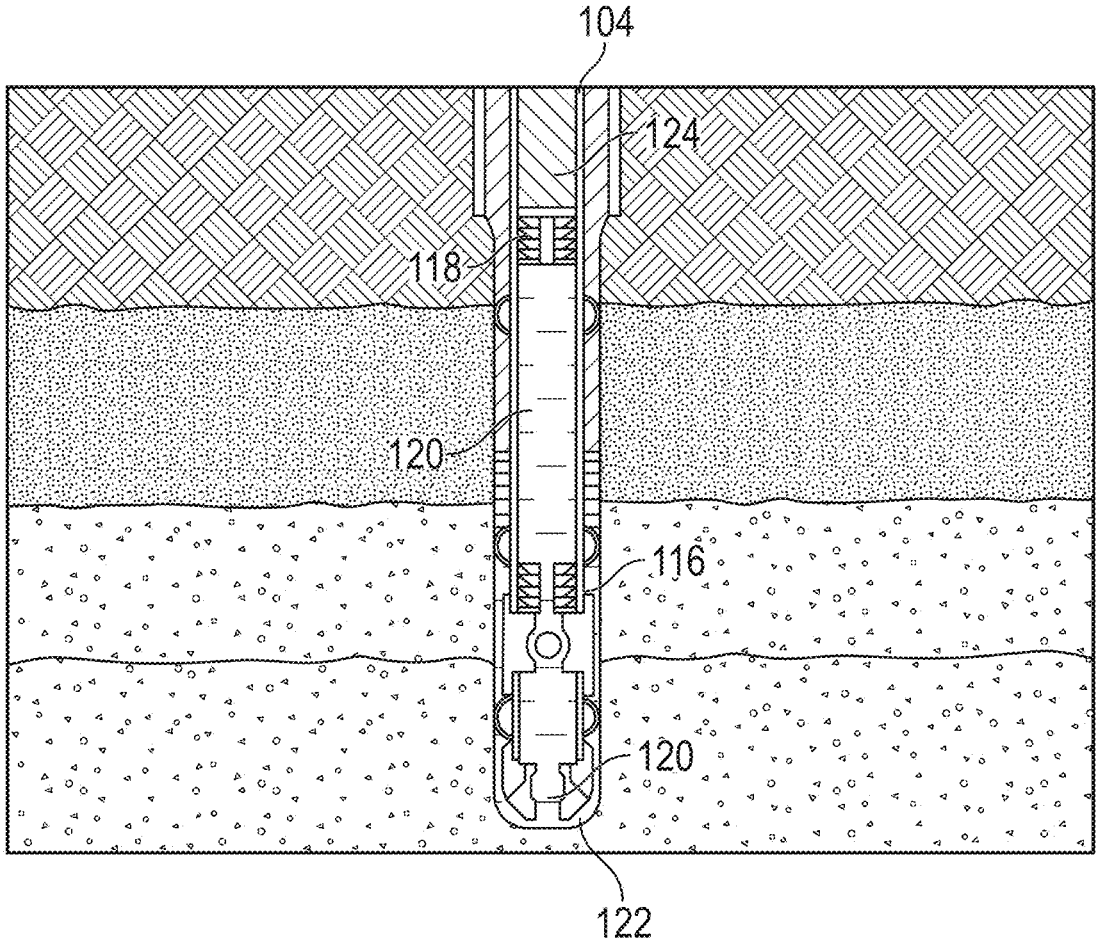
FIG. 2 (PRIOR ART)
FIG. 2 shows a two-plug cementing operation in progress.
Figure 3:
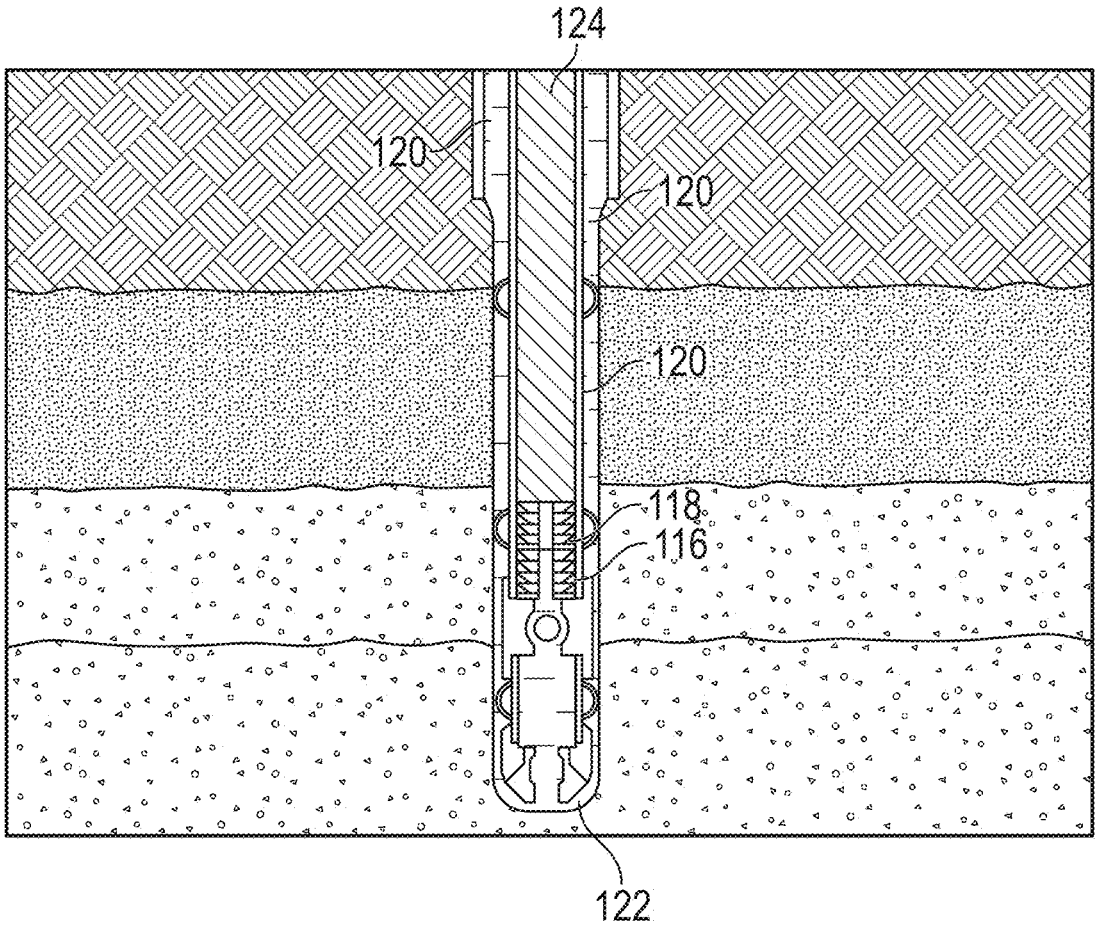
FIG. 3 (PRIOR ART)
FIG. 3 shows a completed two-plug cementing operation.

With reference to FIG. 2, as part of the cementing operation, the bottom plug 116 is placed in the casing string 104 followed by a cement slurry 120. The bottom plug 116 generally includes a membrane that ruptures when it lands at the bottom of the casing string, allowing the cement slurry to pass through the bottom plug 116 and enter the annulus 122. Once a sufficient volume of cement slurry 120 has been pumped to fill the annular region 122 between the casing string 104 and the borehole wall, the top cementing plug 118 is released, followed by the displacement fluid 124. The top plug 118 serves to separate the cement slurry 120 from the displacement fluid 124. The top cementing plug 118 does not have a membrane. Therefore, when it lands, hydraulic communication is severed between the casing interior and the annulus (FIG. 3). After the cementing operation, operators wait for the cement to set and develop strength—known as "waiting-on-cement" (WOC). After the WOC time, further operations such as drilling deeper or perforating the casing string may commence.

When performing the cementing operation, care should be taken to avoid either over-displacing or under-displacing the top plug 118. When the top plug 118 is over-displaced, the displacement fluid 124 can enter the annulus 122. In the industry, over-displacement is called a "wet shoe" and results in contamination or absence of the cement in the casing section between the float collar and the guide shoe. Correcting a poor cement isolation caused by over-displacement requires a costly remedial squeeze cementing operation. Similarly, when the cementing operation is stopped too soon such that the top plug is under-displaced, a significant volume of cement slurry can remain within the interior of the casing string. Consequently, an additional drilling run must be performed to clean out the excess cement so that subsequent operations, such as perforation of the formation, are delayed.

To avoid these problems, many well operators determine when to stop the cement displacement operation by tracking the top cement plug position volumetrically by dividing the displaced volume by the casing internal cross-sectional area. However, this volumetric technique is prone to uncertainties, including uncertainties related to displacement fluid compressibility, pressure pump inefficiency, flowmeter inaccuracy, and variance in casing joint diameters. Because this volumetric top plug tracking method is imprecise, many well operators tend to stop displacement of the top plug 118 short of the calculated volume rather than risk a "wet shoe." However, as mentioned, under-displacement of the top plug 118 also is not ideal.

A technology that offers an improvement over the volumetric measurement technique involves monitoring and analyzing pressure pulses that are naturally generated in a fluid-filled casing when a cement plug that is pumped through the casing traverses a region having either a negative or positive change in the inner casing diameter (e.g., a casing collar). The generated pressure pulses can be detected at the surface by an appropriate pressure transducer (e.g., a microphone). The detected pulse signals can then be analyzed by a surface data acquisition system (e.g., a processing system with processing hardware and instructions of software) to identify the plug position relative to the known position of downhole completion components. While this technique is an improvement to the ability to track the position of a plug during a cementing operation, its accuracy can be challenged by inaccurate measurements of casing diameters and the rate at which the displacement fluid is pumped into the casing. Moreover, the strength of the pressure pulses generated by the passage of the plug through a region with an inner diameter change can be dependent on the specific structure of the completion element in that region. As an example, the specific thread type of a casing collar can affect the strength of the generated pressure pulse induced by a passing droppable object.

Accordingly, to improve the performance of the primary cementing operation, embodiments disclosed herein include systems and techniques to detect or track the downhole position of a droppable object within the wellbore, such as the downhole position of a top cement plug within the casing. As used herein, a droppable object is an object that is placed in the wellbore without any tether to the surface. In embodiments described herein, the droppable object is a top cement plug equipped with a locating system.

Figure 4:
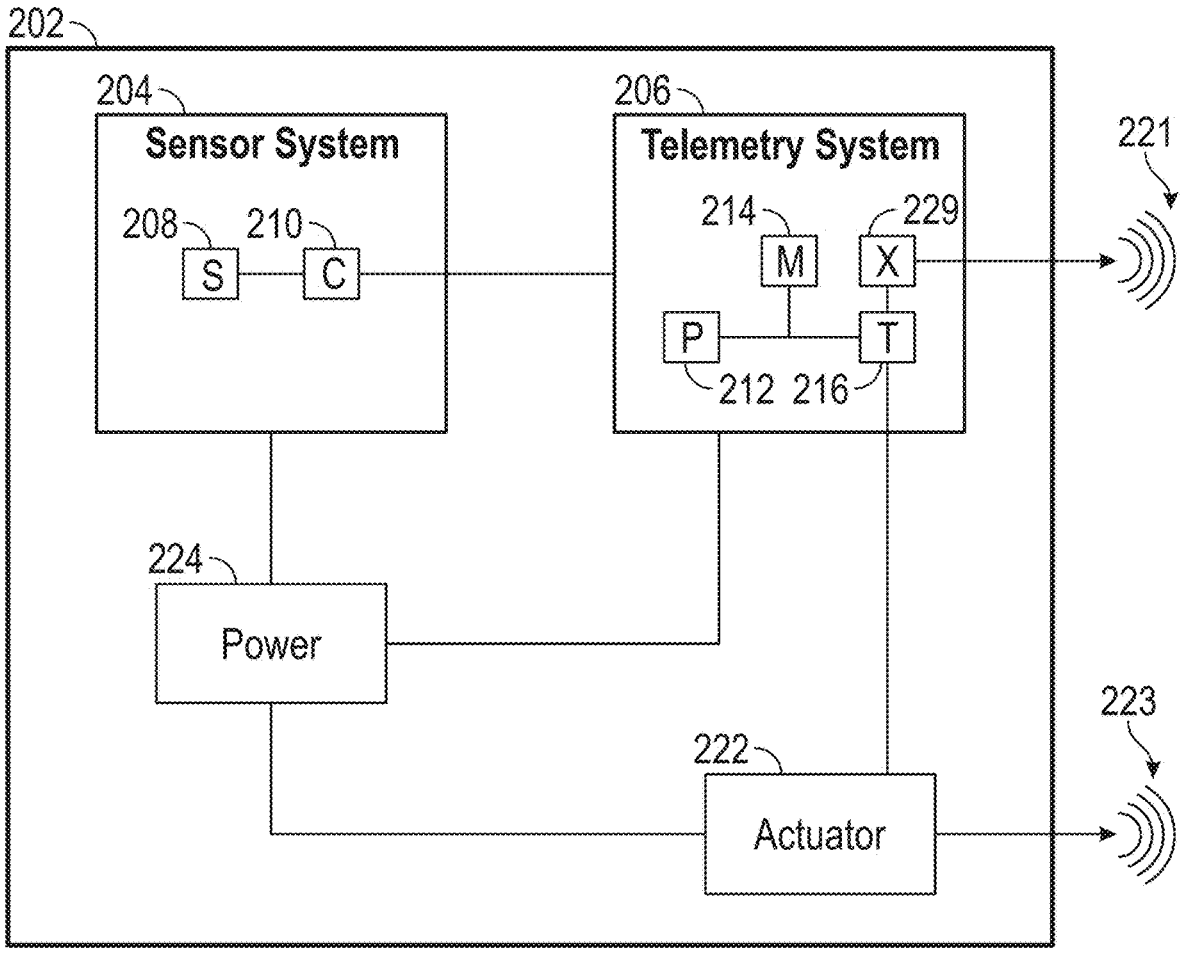
FIG. 4 schematically shows a locating system that can be incorporated with a droppable object, according to an embodiment.

With reference to the schematic diagram of FIG. 4, an example of a locating system 202 includes a sensor system 204 and a telemetry system 206 communicatively coupled to the sensor system 204. The sensor system 204 includes a sensor element 208 to detect a feature of interest and sensor circuitry 210 to generate signals in response to detection of the feature of interest. The telemetry system 206 generally includes a processing device 212 that receives signals from the sensor system 204, a memory device 214, and telemetry signal electronics 216 to generate telemetry signals that are transmitted as acoustic signals that propagate to the surface through the fluid-filled casing. For example, electronics 216 can be coupled to a transmitter 229 (e.g., a piezoelectric transducer) that converts electric telemetry signals to acoustic telemetry signals 221. Electronics 216 also can be coupled to an actuator 222 that, when activated, causes generation of acoustic telemetry signals 223. In embodiments, transmitter 229 can be configured as a transceiver that can receive acoustic signals transmitted from the surface and convert them to corresponding electric signals.

In operation, the sensor system 204 detects specific features of the well as a droppable object 200 (FIGS. 5 and 6) moves downhole past such features. These features can be various types of completion elements, such as casing collars, previous section shoes, joints, or elements that appear as changes in casing wall thickness, which are positioned at known locations within the well. When a feature is detected, the sensor system 204 produces a signal(s) indicative of the presence of the feature. The signal is provided to the telemetry signal system 206, which then generates corresponding electrical signals that are converted to acoustic telemetry signal(s) 221 and/or 223 that serve to encode the position of object 200 relative to the features. In embodiments, the telemetry signals 221 and/or 223 can be in the form of pressure pulses or other types of acoustic signals. The telemetry signals 221 and/or 223 can be transmitted in addition to, or together with, pressure pulses that are naturally generated by the passage of object 200 through regions in the casing that exhibit a change in inner diameter. The telemetry signals (whether signals 221 and/or 223 generated by the telemetry system 206 or pressure pulses naturally induced by the object's movement through a region with a changed diameter) are detected by a receiver 218 and processed and decoded by an acquisition system 220 at the surface of the wellbore (FIG. 7).

In embodiments, the actuator device 222 is arranged so that, when activated, it moves into and out of frictional engagement with the inner wall of the casing 104. For example, the actuator device 222 can be arranged to radially expand from and retract into the body of the object 200. By selectively applying a radially directed frictional force against the casing 104 as the object 200 moves through the casing 104, pressure pulses 223 are generated that propagate to and can be detected at the surface. In embodiments, the acquisition system 220 is configured to determine the position of the object 200 by correlating the detected telemetry signals 221 and/or 223 and/or any naturally induced signals with the previously known positions of the completion elements in the casing string 104. In this manner, the movement of the object 200 within the casing 104 can be tracked and the position of the object 200 can be determined in real time.

The locating system 202 also includes a power system 224, e.g., a battery, to provide power to the sensor system 204, telemetry system 206, and actuator device 222, as needed. The locating system 202 can be contained within a separate housing that is coupled to the body of the object 200, such as by adhering or bonding the housing to the top of the body of a cement plug. In other embodiments, the body of the object 200 can be formed such that the locating system 202 is integral with or encased within the body of the object 200.

In embodiments, as the object 200 (along with its locating system 202) traverses the casing 104, the sensor system 204 detects a completion element by either counting the number of elements passed or identifying a unique signature of the element. For example, the sensor element 208 can be an electromagnetic sensor, and the sensor system 204 can detect a completion element by detecting or measuring changes in the electromagnetic coupling or inductive coupling of the sensor 208 due to changes in the attributes in the wellbore or the completion element. These attributes can include, but are not limited to, the geometry and material of the element being identified. By measuring the changes in electromagnetic or inductive coupling in the sensor 208, the presence of the element or a unique signature of the element can be identified. Identification of the element can be the result of either the response of an unmodified element or the response to specific features added to the element to be detected. For example, grooves or notches can be added to the inner or outer diameter of a completion element in order to intentionally generate a response or signature that can be uniquely identified.

In embodiments, once the sensor system 204 detects an element of interest (by either counting or identifying a unique signature), the locating system 202 will initiate action. For example, in response to a signal from the sensor system 204, the telemetry system 206 can amplify and modulate the signal and generate corresponding acoustic signals 221 that are transmitted to the surface by the telemetry transmitter 229. The action taken by the locating system 202 can also include activating the actuator device 222 such that it expands radially from the body of the object 200, thereby exerting a frictional force against the inner wall of the casing 104, and then retracts, thus generating pressure pulses 223. Regardless of how generated, the telemetry signals then can be detected by the surface acquisition system 220 and processed to determine the position of the object 200. Once the object 200 has reached a desired or determined position in the wellbore, further progress of the object 200 can be stopped, such as by stopping the pumping of the displacement fluid into the casing 104.

Figure 5:
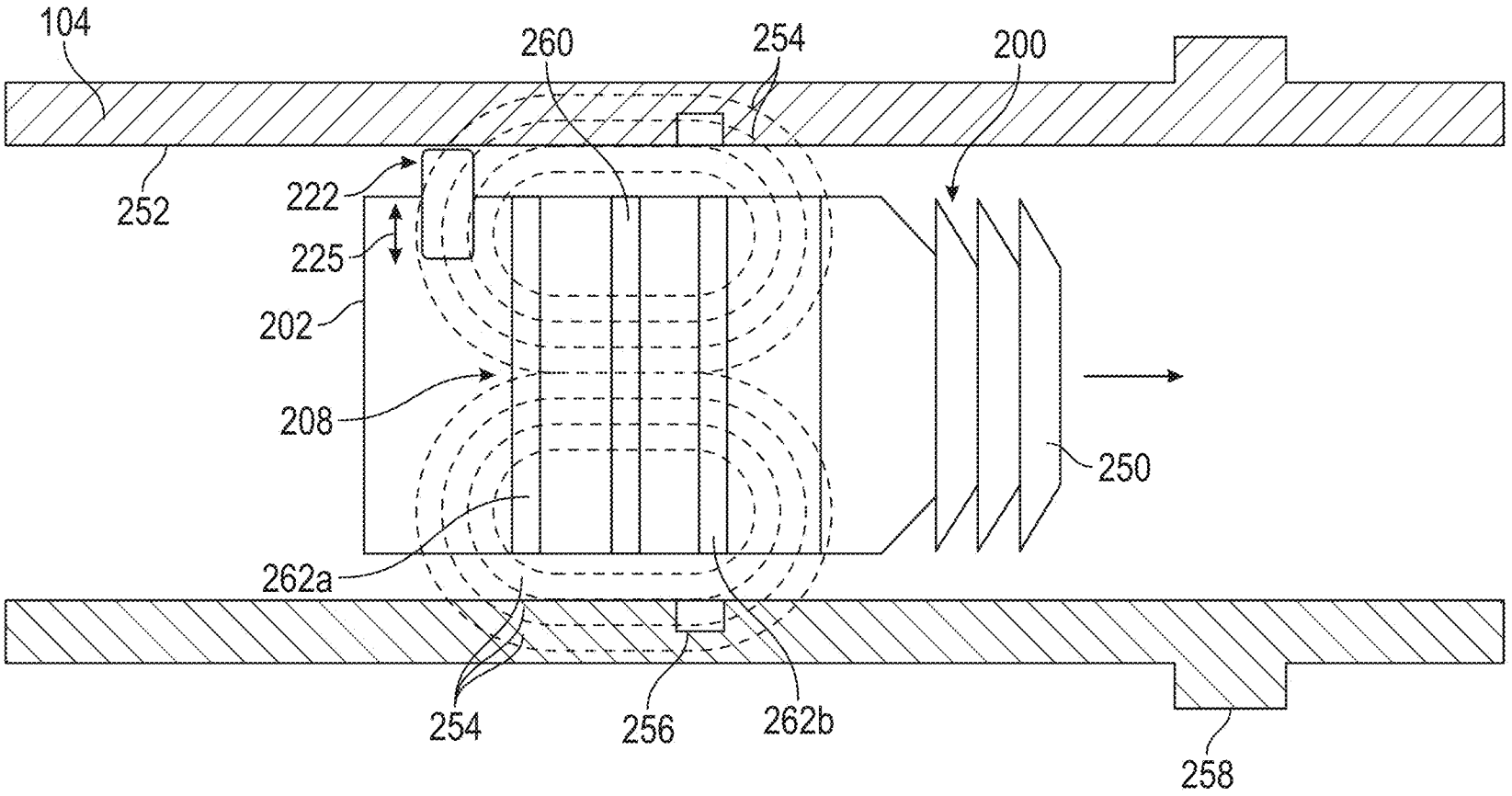
FIG. 5 schematically shows a cement plug equipped with an induction-based locating system that is deployed in a casing, according to an embodiment.

Turning now to FIG. 5, a schematic view of a droppable object 200 equipped with a locating system 202 is shown relative to section of the casing 104. Although this example shows the droppable object 200 as including a top cement plug 250 that is pumped from the surface along with displacement fluid, it should be understood that the droppable object 200 can be a device other than a top cement plug, such as a bottom cement plug, a dart, a ball, or a bar. Further, pumping need not be employed to move the object 200 through the casing 104.

As schematically shown in FIG. 5, the sensor element 208 is an electromagnetic sensor. Magnetic flux lines 254 emanating from sensor element 208 are depicted relative to the casing 104. As the object 200 passes through the casing 104, the sensor system 204 takes inductive measurements to detect or identify an anomaly or feature of interest, such as an increase or decrease in the inner or outer diameter of the casing, e.g., anomalies 256 (a groove) and 258 (a joint). It should be understood, however, that although the examples herein are described with reference to inductive or electromagnetic coupling, other parameters can be measured such as conductance, impedance, capacitance, and others.

As shown in FIG. 5, the electromagnetic sensor 208 is configured as multiple coils, and specifically as a transmitter coil 260 and two receiver coils 262*a* and 262*b*, each disposed on either side of the transmitter coil 260. In embodiments, the receiver coils 262*a*, 262*b* are arranged such that they have co-directional magnetic moments. In other embodiments, the receiver coils 262*a*, 262*b* can be arranged such that they have opposing magnetic moments. In either case, the transmitter coil 260 and receiver coils 262*a*, 262*b* are arranged so that when the object 200 passes by a feature of interest in the casing 104, the sensor system 204 outputs a signal which is then processed by the telemetry system 206.

The transmitter coil 260 can include the same number of windings as the receiver coils 262*a*, 262*b* or a different number of windings. In some embodiments, the transmitter coil 260 can be coupled to the power source 224 (e.g., a battery) so that an electrical current flows through the transmitter coil 260 to create the magnetic flux lines 254. In other embodiments, the sensor element 208 can be a passive device (e.g., one in which no battery or power is provided to the coils). Although three coils are shown in FIG. 5, it should be understood that sensor element 208 can include one coil, two coils, or more than three coils. For example, the sensor 208 may include only one coil configured as an inductive sensor to sense changes in coupling between the coil and the casing.

Regardless of the specific configuration of the sensor system 204, the telemetry system 206 is arranged to detect changes in coupling between the coils of the sensor element 208 as the object 200 moves downhole. For example, if the sensor element 208 is configured as a non-zero sensor (i.e., the coupling between the receiver and transmitter coils cancels out except when the sensor passes a feature of interest), the telemetry system 206 can be configured to respond to a change in the non-zero coupling between the coil 260 and coils 262*a*, 262*b* that occurs when the magnetic flux lines 254 are altered by changes in the features in the casing 104. The telemetry system 206 can process the information detected by the sensor 208 and determine if a set criterion has been met to trigger transmission of telemetry signals 221 and/or 223 to the surface. In embodiments, to transmit telemetry signals 223 to the surface, the telemetry system 206 activates the actuator device 222 so that it projects and retracts radially relative to the body of the object 200 and into and out of frictional engagement with an inner surface 252 of the casing 104 (as represented by directional arrow 225), thereby generating a pressure pulse 223 that propagates within the fluid-filled casing for detection at the surface.

In embodiments, the operating frequency of the signal transmitted between the transmitter and receiver coils 260, 262*a*, 262*b* can be varied in order to change the depth of penetration into the completion components to eliminate features of no interest. For example, by increasing the frequency, the casing couplings that are located outside the casing will not be detected or produce unwanted responses. As an example, the operating frequency can be selected to be within a range of 1 to 100 kilohertz.

Figure 6:
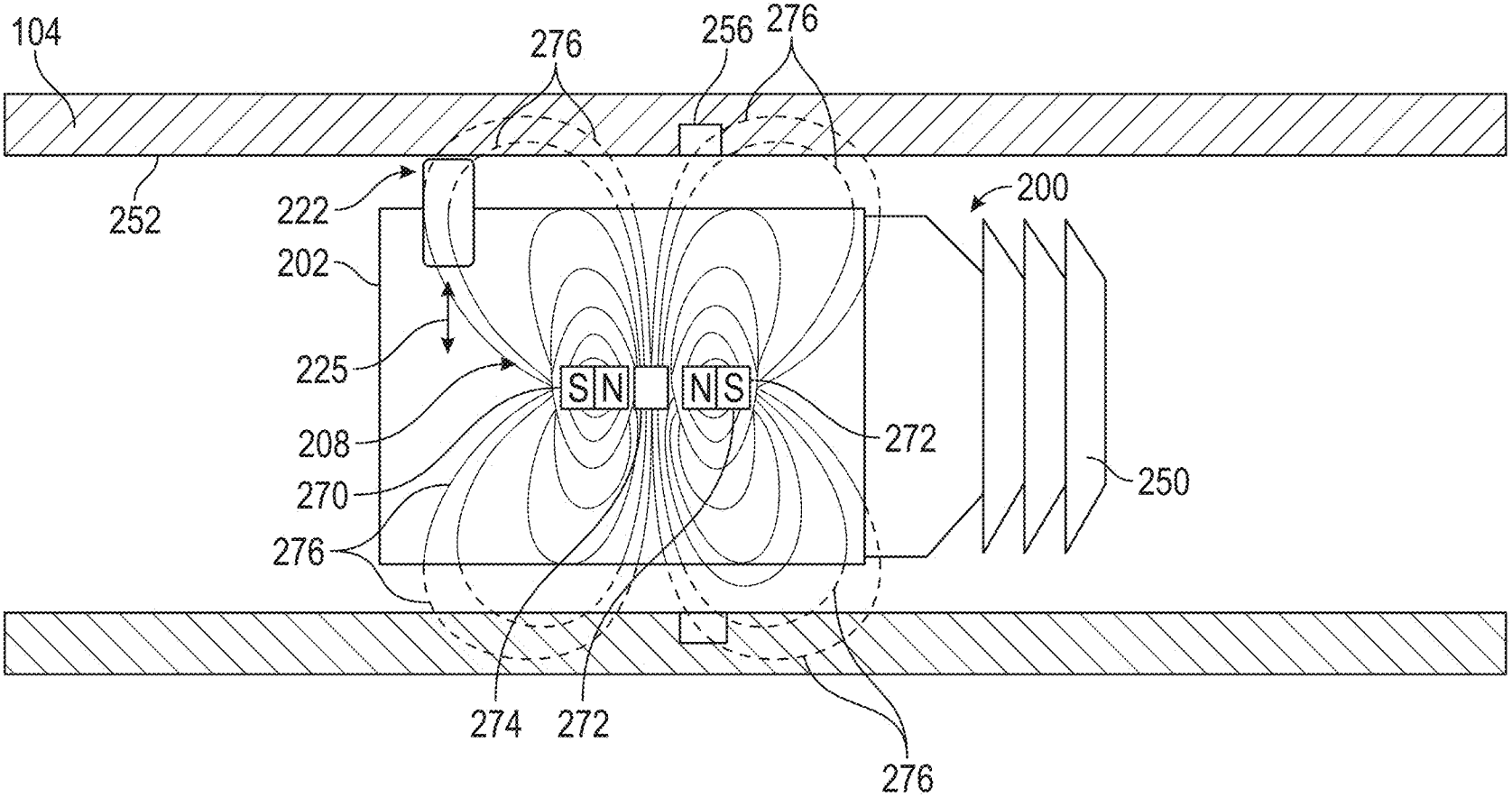
FIG. 6 schematically shows a cement plug equipped with a magnet and magnetometer locating system that is deployed in a casing, according to another embodiment.
Figure 7:
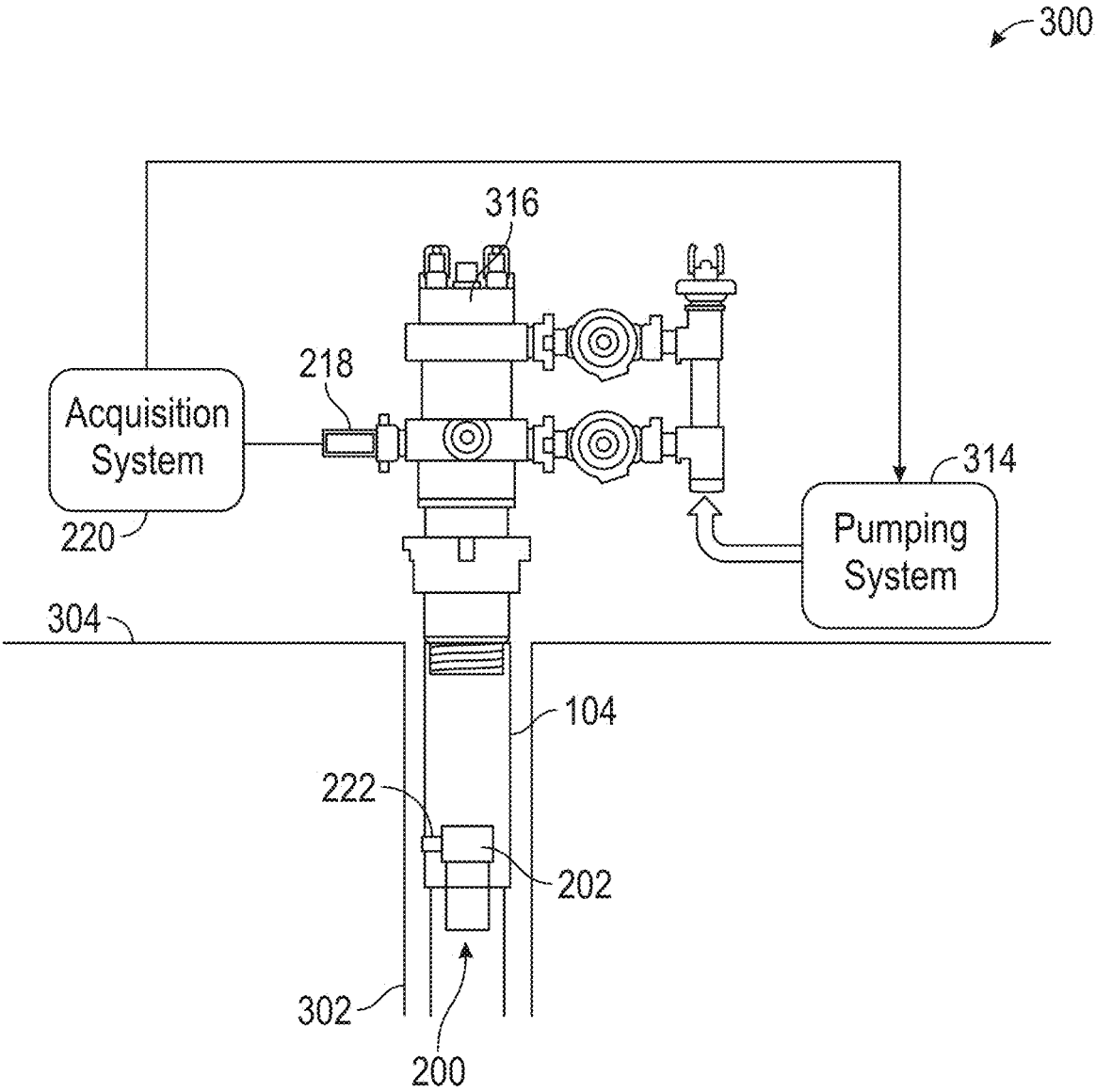
FIG. 7 is a schematic illustration of a well configuration for determining the location of a cement plug during a cementing operation, according to an embodiment.

Another embodiment of a sensor element 208 is shown schematically in FIG. 6. Here, the sensor element 208 is arranged as an axial magnetometer with pairs of like-facing permanent magnets 270, 272 positioned on either side of a magnetometer circuit 274 (e.g., an integrated circuit) that monitors changes in the DC magnetic field between the two like-facing magnetic poles 270, 272. The magnetic lines of flux 276 are distorted when the object 200 passes a location with an anomaly (or feature or interest) in the casing 104, such as a casing collar, a casing wall thickness change, a previous casing shoe, or a change in permeability of the casing material. Distortion of the magnetic flux lines 276 alters the magnitude of the DC magnetic field between the permanent magnets 270, 272. These changes are measured by the magnetometer circuitry 274 as either a positive or negative change depending on the casing parameter that changed. This measurement is then output to the telemetry system 206 for processing and generation of telemetry signals 221 and/or 223 that are transmitted for detection at the surface.

Generally, and as shown in FIG. 4, the telemetry system 206 includes processor 212, which can take any suitable form, such as a controller, an application specific integrated circuit, a field programmable array, a CPU, or other suitable processing device. In some embodiments, the processor 212 can be configured as a counting circuit that keeps track of the number of times the sensor element 208 detects a downhole feature of interest. For example, the count kept by the counting circuit may be iterated each time a change in the magnetic flux or magnetic field generated by the sensor element 208 exceeds a determined threshold as the object 200 travels downhole. In other embodiments, memory 214 may store particular patterns or signatures that can be used as a reference to determine if a sensed change in magnetic flux or magnetic field is of interest. In some embodiments, the processor 212 can determine whether a particular change in the magnetic flux lines or change in the magnetic field should trigger a count. In other embodiments, rather than keeping a count, the processor 212 may determine whether a determined triggering signature has been found.

In response to a triggering event (e.g., a detected component or parameter of interest, a desired count, a determined signature, etc.), the processor 212 can trigger the telemetry signal electronics 216. The electronics 216 can receive a signal from the processor 212 and then generate electrical telemetry signals that are converted to corresponding acoustic telemetry signal(s) 221 and/or 223 that are transmitted to the surface for receipt and processing by the acquisition system 220 to determine the location of the object 200. The acquisition system 220 can detect and process the telemetry signals 221 and/or 223 in addition to detecting and analyzing any pressure pulses naturally induced when the object 200 moves through restricted regions.

FIG. 7 shows a system 300 in which the devices and techniques described herein can be employed. System 300 includes a wellbore 302 extending from a surface 304, fluid-filled casing string 104 run into the wellbore 302, a droppable object 200 equipped with a locating system 202 having an actuator device 222 that is moving within the casing string 104, a telemetry signal receiver 218 located at the surface (e.g., at the wellhead or cementing head) to detect telemetry signals 221 and/or 223 transmitted by the locating system 202 and/or pressure pulses generated by the movement of object 200 through restricted regions, the acquisition system 220 for processing received telemetry signals 221 and/or 223 and/or induced pressure pulses, and at least one pump 314 connected to the casing string 104 via a cementing head 316.

Figure 8:
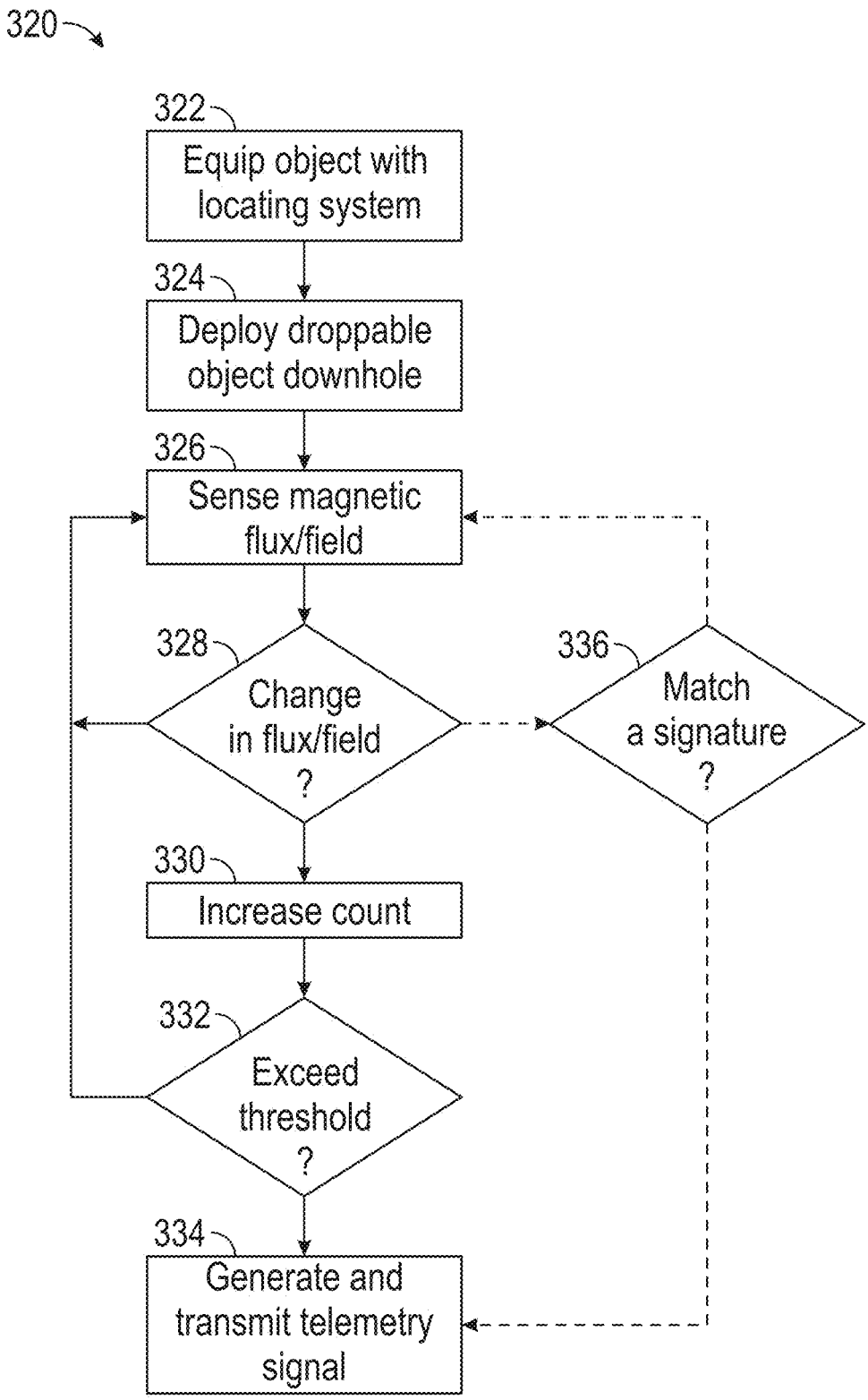
FIG. 8 is a flow diagram illustrating a technique for determining the location of a droppable object in a wellbore, according to an embodiment.

FIG. 8 is a flowchart illustrating a technique 320 for determining the location of a droppable object in a wellbore in accordance with an example embodiment. The technique includes equipping the droppable object with a locating system (block 322) and deploying the locatable, droppable object downhole (block 324). As the object moves downhole, the magnetic flux lines or magnetic field are sensed (block 326). A determination is made as to whether there have been changes in the flux lines or magnetic field (block 328). If no changes have been detected, then sensing continues (block 326). If a change is detected, a count is increased (block 330). If the count exceeds a determined threshold (block 332), the telemetry signal electronics are activated and one or more telemetry signals are generated and transmitted to the surface (block 334). If the count threshold has not been exceeded, then sensing continues (block 326).

In embodiments, signatures may be sensed. Specifically, when there is a change in the flux lines or magnetic field (block 328), the change may be compared against stored signatures to check for a match (block 336). If there is no match, sensing continues (block 326). If there is a match, the telemetry signal electronics are activated, and one or more telemetry signals are generated and transmitted to the surface (block 334).

It should be appreciated that other techniques can be implemented in certain embodiments. For example, in some embodiments, a signature may be matched to increase a count and a threshold number of signatures may be matched before triggering the telemetry electronics.

It also should be appreciated that the telemetry signals can be generated and transmitted to the surface in a variety of forms. For example, in some embodiments, a single pressure pulse or acoustic signal can be generated and transmitted when either a count is exceeded or a determined signature is identified. In embodiments, a telemetry signal can be generated and transmitted each time a change in magnetic flux is detected or each time a specific signature is detected. Yet further, the telemetry signals can be encoded in a particular manner or with a particular signature depending on the specific feature that has been detected. Regardless, the telemetry signals are received at the surface and then can be decoded and analyzed in real-time by the acquisition system 220 at the surface. For example, the acquisition system 220 can use known information about the casing joint sequence called a casing tally. The casing tally is a table that stores the lengths and positions of all casing collars. Received telemetry signals generated in response to the object passing a casing collar can be correlated with the casing tally to determine the location of the object. Once the object has reached or is nearing a desired location, further progress of the object can be halted. For example, the acquisition system 220 can generate a command that directs the pumping system 314 to terminate the cementing operation, such as by halting further pumping of the displacement fluid into the casing 304 (FIG. 7).

Yet further, in addition to receiving telemetry signals from downhole, the surface equipment can also include a processing system that is configured to generate information, such as commands or programming data, for communication to the droppable object 200. For example, the object's locating system 202 can also include a receiver or transceiver to receive information from surface equipment. The information can be communicated to the locating system 202 either at the surface before deploying the object 200 in the wellbore. Information can also be communicated to the locating system 202 after deploying the object 200 in the wellbore, such as by transmitting the information in the form of pressure pulses that can be received by transducer 229. As an example, in order to conserve battery power, the object 200 may be deployed with its locating system 202 in a standby or sleep state. Once in the wellbore and at a particular time during an operation that is being performed, a command can be transmitted from the surface to wake up the locating system 202. As another example, a command can be transmitted from the surface to instruct the locating system 202 to take a particular action, such as to activate the actuator device 222.

Although embodiments have been described in the context of a primary cementing operation, it should be understood that the structure, systems and techniques can be used with other types of operations or testing that involve use of a droppable object in a well. Further, the cementing operation described herein may include different or additional phases or modes than those described above, and the various actions taken in each phase can be different than those described above or may be performed in different manners.

While the present disclosure has been disclosed with respect to a limited number of embodiments, those skilled in the art, having the benefit of this disclosure, will appreciate numerous modifications and variations there from. It is intended that the appended claims cover such modifications and variations as fall within the true spirit and scope of the invention.

What is claimed is:

1. A method for determining the location of a droppable object as it travels in a wellbore, comprising:

deploying a droppable object in a casing string disposed in the wellbore, the casing string including a plurality of completion components, wherein the droppable object includes an integral locating system, the locating system comprising a sensor system and an actuator device;

pumping a fluid behind the droppable object, causing the droppable object to travel through the interior of the casing string and past one or more of the completion components;

detecting, by the sensor system, a completion component as the droppable object travels past the completion component;

counting a number of detected completion components;

generating a telemetry signal corresponding to detection of the completion component for receipt by a surface acquisition system, wherein generating the telemetry signal comprises activating the actuator device to apply a radially directed force against an inner surface of the casing string, thereby generating a pressure pulse, and wherein the telemetry signal is generated when the counted number of detected completion components exceeds a determined threshold; and determining, by the surface acquisition system, a location of the droppable object within the casing string based on the telemetry signal.

2. The method as recited in claim 1, wherein detecting a completion component comprises detecting a change in the inner diameter or the outer diameter of the casing string.

3. The method as recited in claim 1, wherein detecting a completion component comprises detecting a change in cross-sectional thickness of a wall of the casing string.

4. The method as recited in claim 1, wherein the sensor system comprises an electromagnetic sensor, and wherein detecting a completion component comprises detecting a change in magnetic flux lines associated with the electromagnetic sensor.

5. The method as recited in claim 4, wherein the electromagnetic sensor comprises a magnetometer having a pair of like-facing permanent magnets.

6. The method as recited in claim 4, wherein the electromagnetic sensor comprises a plurality of coils, wherein at least one coil is a transmitter coil and at least one coil is a receiver coil, and wherein detecting a completion component comprises detecting a change in an electromagnetic coupling between the at least one transmitter coil and the at least one receiver coil.

7. The method as recited in claim 6, further comprising matching the detected change to a signature of the completion component, wherein the telemetry signal is generated based on the matching.

8. The method as recited in claim 1, further comprising stopping travel of the droppable object in the casing string based on the determined location of the object.

9. The method as recited in claim 1, wherein the droppable object is a cement plug deployed in the casing string during a primary cementing operation.

* * * * *